US008425152B1

(12) United States Patent
South

(10) Patent No.: US 8,425,152 B1
(45) Date of Patent: Apr. 23, 2013

(54) ARCHED CULVERT AND METHOD OF MANUFACTURE

(75) Inventor: Jason P. South, Idaho Falls, ID (US)

(73) Assignee: E & D Company, LLC, Idaho Falls, ID (US)

( * ) Notice: Subject to any disclaimer, the term of this patent is extended or adjusted under 35 U.S.C. 154(b) by 477 days.

(21) Appl. No.: 12/612,283

(22) Filed: Nov. 4, 2009

(51) Int. Cl.
*E02D 29/00* (2006.01)

(52) U.S. Cl.
USPC ..... 405/134; 405/124; 405/135

(58) Field of Classification Search ..... 405/124, 405/125, 126, 134, 135, 151; 52/88
See application file for complete search history.

(56) References Cited

U.S. PATENT DOCUMENTS

| | | | | |
|---|---|---|---|---|
| 4,142,705 | A | 3/1979 | Miller | |
| 4,219,513 | A | 8/1980 | Miller | |
| 4,314,775 | A * | 2/1982 | Johnson | 405/155 |
| 4,687,371 | A | 8/1987 | Lockwood | |
| 4,797,030 | A | 1/1989 | Lockwood | |
| 4,854,775 | A | 8/1989 | Lockwood | |
| 4,930,937 | A | 6/1990 | Fulton | |
| 4,953,280 | A | 9/1990 | Kitzmiller | |
| 4,983,070 | A | 1/1991 | Hwang | |
| 4,993,872 | A | 2/1991 | Lockwood | |
| 5,118,218 | A | 6/1992 | Musser et al. | |
| 5,252,002 | A | 10/1993 | Day | |
| 5,375,943 | A | 12/1994 | McCavour et al. | |
| 5,720,577 | A | 2/1998 | Sanders et al. | |
| 6,092,962 | A | 7/2000 | Lee | |
| D454,203 | S | 3/2002 | Bellavance | |
| 6,367,214 | B1 * | 4/2002 | Monachino | 52/247 |
| D484,609 | S | 12/2003 | Harrington et al. | |
| 6,827,326 | B2 | 12/2004 | Giri | |
| 6,854,928 | B2 | 2/2005 | Lockwood | |
| 7,080,956 | B2 | 7/2006 | Neden et al. | |
| 7,614,830 | B1 * | 11/2009 | Ritke | 405/286 |

OTHER PUBLICATIONS

Hydro-Arch, *Hydraulic Design Handbook for Arches*, Mar. 16, 2009, 7 pages, http://hydro-arch.com/system.htm.
Contech Bridge Solutions, Inc., *Bridge Solutions*, Jun. 2, 2008, www.contech-cpi.com/bridges/products/precast/con_span/the_system/294.

* cited by examiner

*Primary Examiner* — David Bagnell
*Assistant Examiner* — Benjamin Fiorello
(74) *Attorney, Agent, or Firm* — Workman Nydegger

(57) ABSTRACT

An arched culvert includes a first foundation having a top surface with a plurality of first reinforcing members upwardly projecting therefrom. A first arch includes a body having an arched interior surface and an opposing exterior surface extending between a first end and an opposing second end, the first end of the first arch being positioned on the top surface of the first foundation adjacent to the first reinforcing members. A first opening extends through the first arch between the interior surface and the exterior surface at the first end thereof. A first locking wall is formed on the top surface of the first foundation so that at least a portion of the first reinforcing members are embedded within the first locking wall and the first locking wall extends along the exterior surface of the first arch and into the first opening of the first arch.

21 Claims, 15 Drawing Sheets

ARCHED CULVERT AND METHOD OF MANUFACTURE

CROSS-REFERENCE TO RELATED APPLICATIONS

Not applicable.

BACKGROUND OF THE INVENTION

1. The Field of the Invention

The present invention relates to arched culverts, methods of manufacture, and related components thereof.

2. The Relevant Technology

Arched culverts are used for forming large volume water pathways that cover and direct a flow of water. For example, arched culverts are commonly used for capturing and directly all or a portion of the water from streams or small rivers, transporting runoff water through large cities, and forming bridges under which water travels.

Depicted in FIG. 1 is a conventional arched culvert 1 bounding a water pathway 7. Arched culvert 1 comprises a concrete slab 2 having a top surface 3 with a pair of spaced apart keyways 4A and 4B extending along the length thereof. A plurality of arches 5A-5C are positioned end-to-end on top surface 3 of slab 2. More specifically, opposing ends 6A and 6B of each arch 5A-5C are received within keyways 4A and 4B, respectively. A grout is filled into any space within keyways 4A and 4B not occupied by ends 6A and 6B of arches 5A-5C.

The assembled configuration of arched culvert 1 forms water pathway 7 that is bounded between the interior surface of arches 5A-5C and top surface 3 of slab 2. The length of slab 2 and the number of arches used depends on the desired length for arched culvert 1. Arched culvert 1 is formed below ground surface so that when completed, a backfill material is deposited over the top of arched culvert 1, thereby forming an underground tunnel on which roads and/or some other structures can be built.

Although conventional arched culverts are used extensively for transporting water, the conventional systems and methods of manufacture have significant shortcomings. For example, the only structural engagement between arches 5A-5C and slab 2 is the freely disposed placement of the ends 6A and 6B of the arches 5A-5C within keyways 4A and 4B. That is, keyways 4A and 4B are intended to prevent lateral movement of arches 5 relative to slab 2. However, slab 2 is formed as a poured-in-place concrete slab. Forming keyways 4A and 4B along the length of slab 2 substantially increases the time, effort and cost to form slab 2. Furthermore, the placement of keyways 4A and 4B must be made at a fairly close tolerance so that ends 6A and 6B of arches 5A-5C can be received therein. Any misalignment of keyways 4A and 4B results in substantial labor and effort to reform slab 2 for receiving the arches.

Even if arches 5A-5C are properly received within keyways 4A and 4B, because there is no structural fastener that positively secures arches 5A-5C to slab 2, it is not uncommon for one or more of arches 5A-5C to become laterally displaced relative to slab 2 as a result the ends of arches 5A-5C moving out of keyways 4A and 4B. This can occur when backfill is applied against arches 5A-5C or when fluid pressures, such as those caused by flood waters, are applied against the interior surface of arches 5A-5C. Furthermore, to facilitate proper longitudinal alignment between adjacent arches 5A-5C, it is often necessary to upwardly shim one or more ends of arches 5A-5C. By upwardly shimming the walls, however, the walls are partially raised within or out of channel 4A and/or 4B, thereby further decreasing resistance to lateral displacement. Any lateral displacement of arches 5A-5C can result in erosion of the surrounding soil and can potentially lead to failure of one or more of arches 5A-5C.

In addition to having low shear resistance, because there is no positive structural connection between arches 5A-5C and slab 2, arches 5A-5C have minimal resistance to applied moment or torsional forces. As a result, arched culvert 1 has greater susceptibility to failure or at least displacement when subject to a variety of different loads.

Accordingly, what are needed in the art are arched culverts and methods of manufacture that eliminate or minimize all or some of the above shortcomings.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

The present invention relates to arched culverts, structural components thereof, and methods of manufacture. It is appreciated that that arched culverts of the present invention can be used for a variety of different purposes. By way of example and not by limitation, the arched culverts can function as covered waterways, bridges, tunnels, shelters, combinations thereof or for other conventional or non-conventional purposes. Arched culverts are commonly used for transporting sewage, waste water or potable water and can be used to contain pressurized or non-pressurized flows. It is also appreciated that the arched culverts can be positioned below ground, partially below ground, or above ground.

Figure 2:
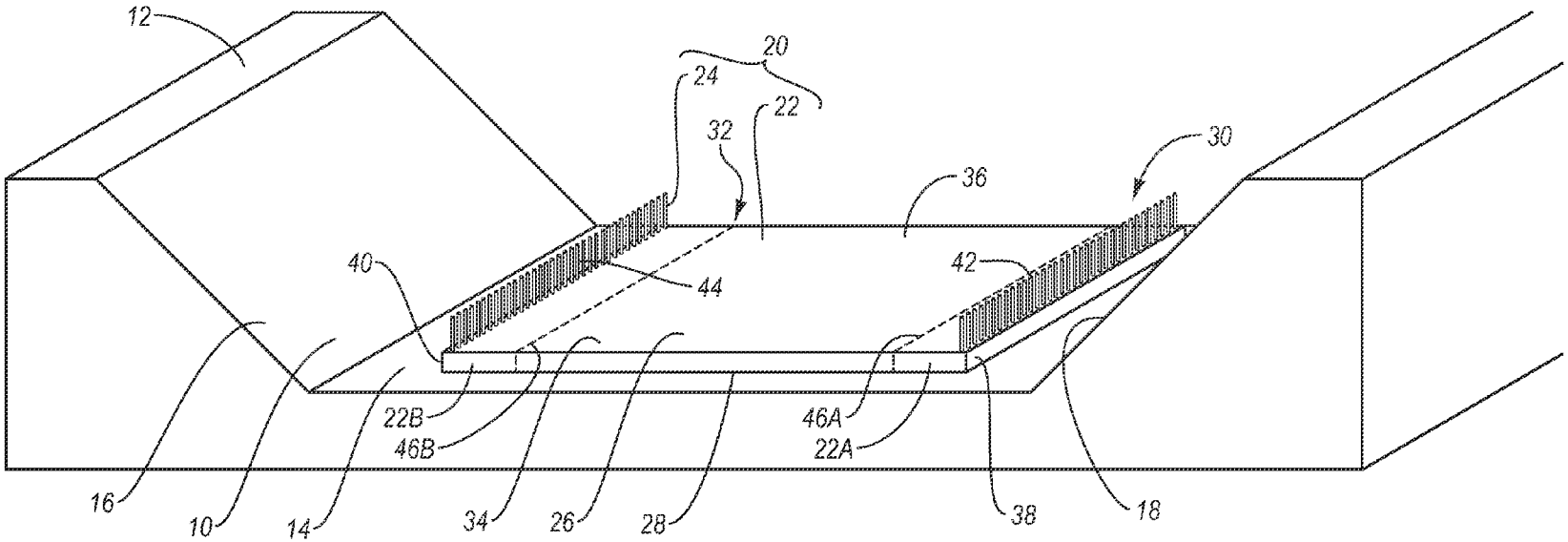
FIG. 2 is a perspective view of a foundation used in an inventive arched culvert.

Turning to FIG. 2, an elongated channel 10 is dug into or otherwise formed on a ground surface 12 for formation of one embodiment of an inventive arched culvert. Channel 10 has a floor 14 having opposing side embankments 16 and 18 that slope away from floor 14. It is appreciated that the inventive arched culvert can be of relatively short length, such as when it is functioning as a bridge, or can extend for miles, such as when it is being used as an underground waterway. In this latter case, the arched culvert is progressively formed in discrete sections.

Independent of the embodiment, the arched culvert comprises a foundation 20. Foundation 20 comprises a slab 22 reinforced with rebar 24. Slab 22 is typically comprised of a cementitious material, such as hydraulic cement, mixed with an aggregate. It is appreciated that conventional concretes can be used having various types and grades of aggregate. Likewise, any number of conventional fillers and additives can also be used. In alternative embodiments, slab 22 can be comprised of metal, polymeric materials, fiberglass, stone, and/or other structural building materials.

In the depicted embodiment, slab 22 has a top surface 26 and an opposing bottom surface 28 that extend between a first side 30 and an opposing second side 32. Surfaces 26 and 28 also extend between a first end 34 and an opposing second end 36. First side 30 terminates at a first side face 38 while second side 32 terminates at a second side face 40. Although not required, top surface 26 and bottom surface 28 are typically disposed in parallel planes. Slab 22 typically has a width extending between side faces 38 and 40 in a range between about 1 meter to about 20 meters with about 2 meters to about 7 meters being more common. Likewise slab 22 typically has a thickness extending between top surface 26 and an opposing bottom surface 28 in a range between about 10 centimeters to about 100 centimeters with about 15 centimeters to about 45 centimeters being more common. The dimensions depend upon the intended use and other dimensions can also be used.

In contrast to having slab 22 that continuously extends between opposing side faces 38 and 40, in one alternative embodiment slab 22 can comprise two spaced apart slabs or strip footings. Specifically, a first slab 22A extends from side face 38 to dashed line 46A and a second slab 22B extends from side face 40 to dashed line 46B. In this embodiment, a separate slab is provided for each end of the arch as will be discussed below in greater detail. The portion of slab 22 between dashed lines 46A and 46B can be eliminated.

Rebar 24 is partially disposed within slab 22 with the size, quantity, and placement of the rebar being based upon conventional structural design parameters. Upwardly projecting from top surface 26 of slab 22 along first side 30 are a plurality of first rebar sections 42. Similarly, upwardly projecting on top surface 26 of slab 22 along second side 32 are a plurality of second rebar sections 44. Rebar sections 42 and 44 are commonly connected with longer sections of rebar disposed within slab 22 so that rebar section 42 and 44 are firmly secured to slab 22. Furthermore, rebar sections 42 and 44 can comprise the opposing ends of discrete pieces of rebar or can be separate pieces of rebar. Rebar sections 42 and 44 can be disposed directly adjacent to side faces 38 and 40 or can be spaced apart therefrom by a distance typically in a range between about 5 centimeters to about 50 centimeters with about 5 centimeters to about 20 centimeters being more common. Other dimensions can also be used.

Although rebar sections 42 and 44 are each shown as being disposed in a linear line, different rebar sections can also be staggered horizontally apart from each other but still placed in relative proximity. Rebar sections 42 and 44 typically have an exposed length in a range between about 30 centimeters to about 400 centimeters with about 30 centimeters to about 75 centimeters or about 80 centimeters to about 150 centimeters being more common. Again, depending on the intended design and use, other dimensions can also be used.

Foundation 20 is typically a pour-in-place structure. Alternatively, foundation 20 can be a prefabricated structure that is sat in place. In this regard, foundation 20 can comprise a plurality of discrete sections that are progressively poured in place or progressively sat in place.

Figure 3:
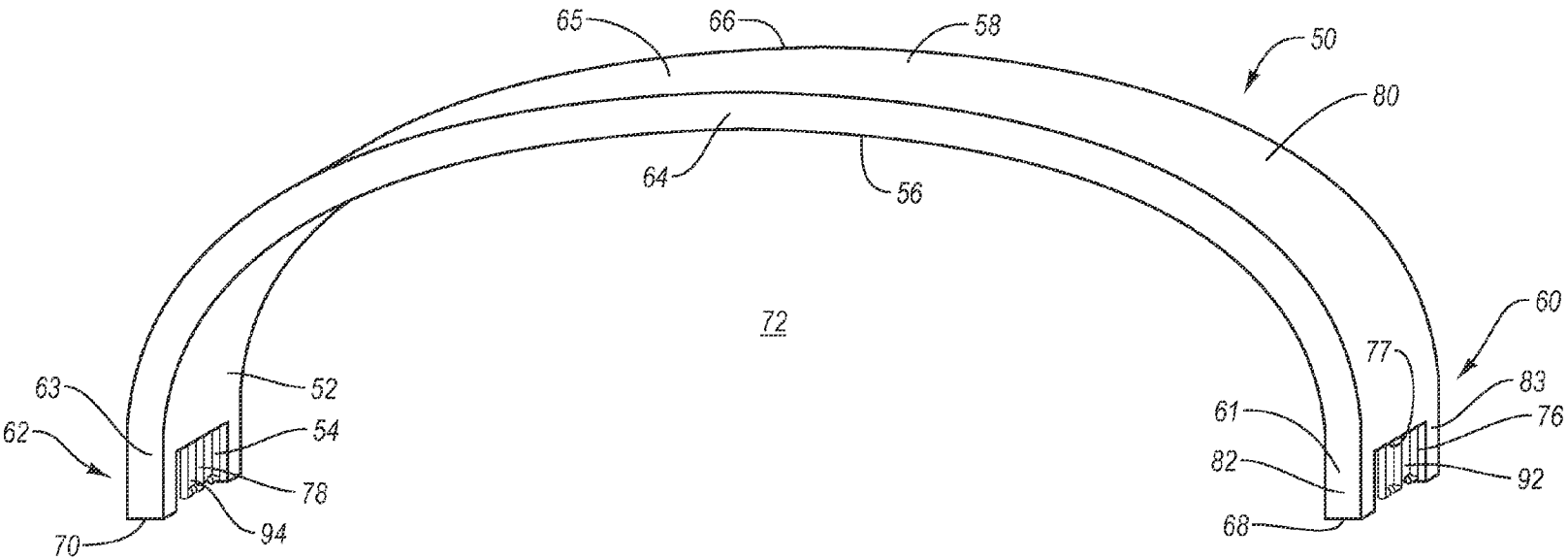
FIG. 3 is a perspective view of an arch used in the inventive arched culvert.

Depicted in FIG. 3 is one embodiment of an arch 50 incorporating features of the present invention. As will be discussed below in greater detail, arch 50 is used in association with foundation 20 for forming one embodiment of an inventive arched culvert. Although arch 50 can be formed as a form-in-place structure on top of foundation 20, arch 50 is typically a prefabricated structure that is formed remotely or on-site and then transported to and placed on top of foundation 20. Arch 50 generally comprises an arch body 52 having rebar 54 disposed therein. Arch body 52 is typically comprised of a cementitious material, such as hydraulic cement mixed with an aggregate. It is appreciated that conventional concretes can be used having various types and grades of aggregate. Likewise, any number of conventional fillers and additives can also be used. In alternative embodiments, body 52 can be comprised of metal, polymeric materials, fiberglass, and/or other structural building materials.

Arch body 52 comprises an arched interior surface 56 having a concave configuration and an arched exterior surface 58 having a convex configuration that each extend between a first end 60 and an opposing second end 62. Surfaces 56 and 58 can be complementary to each other but need not be so. Surfaces 56 and 58 also extend between a first arched side face 64 and an opposing second arched side face 66. Arch body 52 can also be defined as comprising a vertically extending first arch wall 61 located at first end 60 that terminates at a first support face 68 and a vertically extending second arch wall 63 located at second end 62 that terminates at a second support face 70. An arched upper wall 65 spans between arch walls 61 and 63. Interior surface 56 partially bounds a passageway 72. Arch body 52 typically has a thickness extending between interior surface 56 and exterior surface 58 that is in a range between about 10 centimeters to about 60 centimeters with about 15 centimeters to about 45 centimeters being more common. The thickness can be uniform along the length of body 52 or can vary along the length based on structural requirements. Arch body 52 is curved but typically does not have a constant curvature or radius. The optimum configuration or curvature of arch body 52 depends upon the intended use and can be determined using conventional structural design techniques.

Figure 3A:
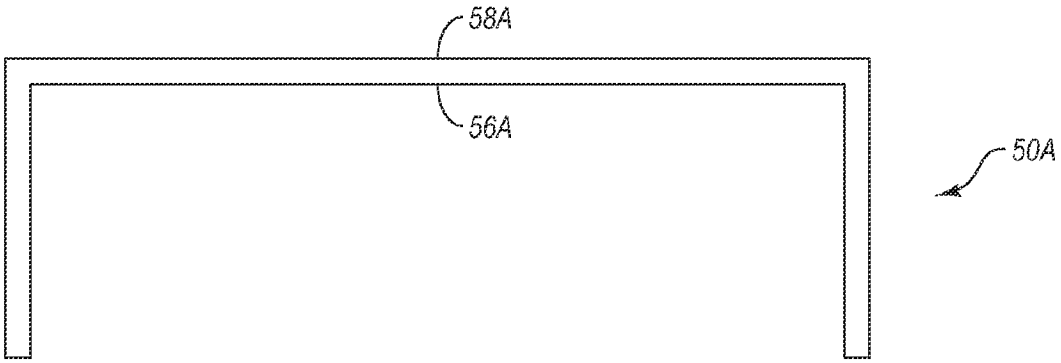
FIGS. 3A and 3B are perspective views of alternative embodiments of arches.

The term "arch" as used in the specification and appended claims, such as in arch body, arched culvert, arched contour, and the like, is broadly intended to include both conventional curved arches, as discussed above, and other related arch type structures that can function for the same purpose. For example, depicted in FIG. 3A is an alternative embodiment of an arch body 50A. Arch body 50A has an arched interior surface 56A and an arched exterior surface 56A which each comprise two vertical side surfaces and one horizontal top surface extending therebetween. In this regard, arch body 50A forms a three sided square or rectangular structure referred to as a box culvert. Box culverts are herein considered a type of arched culvert.

Figure 3B:
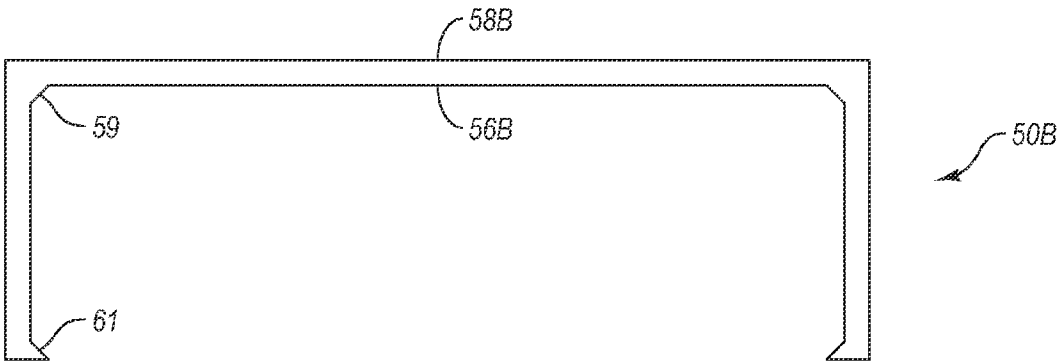

Depicted in FIG. 3B is another alternative embodiment of an arch body 50B having an arched interior surface 56B and an arched exterior surface 58B. Arched interior surface 56B is similar to arched interior surface 56A except that interior surface 56B includes tapered corners 59 and tapered footing 61 to increase structural support. Other arched structures can also be formed of other combinations of linear surfaces, curved surfaces, irregular surfaces or combinations of the different types of surfaces.

Returning to FIG. 3, a first passage 76 extends through arch body 52 between interior surface 56 and exterior surface 58 at first end 60. First passage 76 is bounded by an inside face 77 that extends between surfaces 56 and 58. In the depicted embodiment, first passage 76 also extends through first support face 68 such that first passage 76 forms a notch on first support face 68. Notch 76 has a substantially square or rectangular transverse cross section. In alternative embodiments, notch 76 can have a variety of alternative transverse cross sectional configurations such as semicircular, triangular, or other polygonal or irregular configurations. For example, depicted in FIG. 4A is an alternative embodiment of a first passage 76A having a curved arched or substantially semicircular transverse cross section.

Returning to FIG. 3, a second passage 78 extends through arch body 52 between interior surface 56 and exterior surface 58 at second end 62 so as to pass through second support face 70. Second passage 78 can have the same or different configuration from that previously discussed with regard to first passage 76. In one embodiment, passages 76 and 78 have a maximum height in a range between about 10 centimeters to about 60 centimeters with about 15 centimeters to about 45 centimeters being more common. Likewise, passages 76 and 78 can have a maximum width in a range between about 60 centimeters to about 250 centimeters with about 120 centimeters to about 200 centimeters being more common. Again, the size and dimensions of passages 76 and 78 can vary widely based upon structural design, size, and intended use and thus other dimensions can also be used.

As a result of the presence of passages 76 and 78, arch body 52 can also be defined in terms of an arched upper body 80 that extends between passages 76 and 78 and a pair of spaced apart legs 82 and 83 that project from upper body 80 on opposing sides of passages 76 and 78. In one embodiment, upper body 80 and legs 82 and 83 can form a single unitary member formed as a single continuous pour of concrete. In alternative embodiments, one, both, or parts of legs 82 and 83 can be comprised of a separate structural member that is secured to upper body 80. For example, legs 82 and 83 can be comprised of metal columns, plates, or rods that are secured to upper body 80. In one embodiment, it is appreciated that all or part of legs 82 and 83 can form part of first arch wall 61 as discussed with FIG. 3.

Figure 4B:
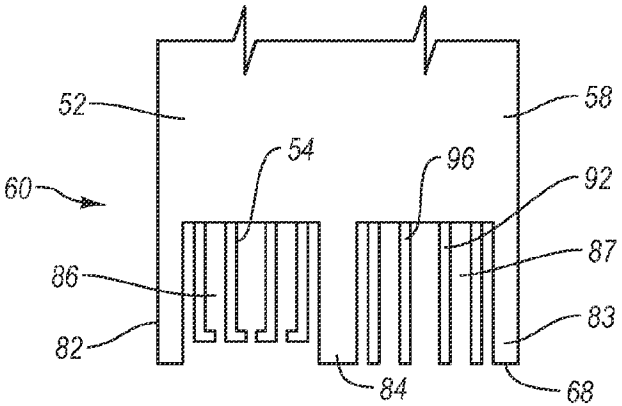
FIGS. 4A-4D are elevated front views of alternative embodiments of one end of the arch shown in FIG. 3.

In a further alternative embodiment shown in FIG. 4B, it is appreciated that a plurality of passages can extend through arch body 52 at one or both ends. For example, as shown in FIG. 4B a pair of spaced apart passages 86 and 87 extend through arch body 52 between interior surface 56 and exterior surface 58 at first end 60 so as to extend through support face 68. As a result, passages 86 and 87 are bounded by legs 82 and 83 with a leg 84 centrally separating the two passages. Again, passages 86 and 87 can have any desired transverse cross sectional configuration as previously discussed with other passages.

Figure 4D:
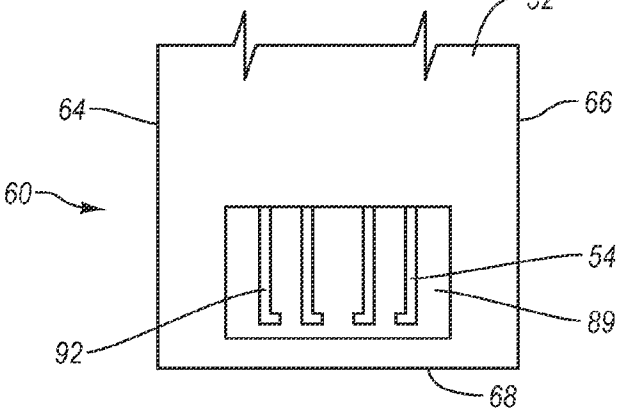
Figure 4A:
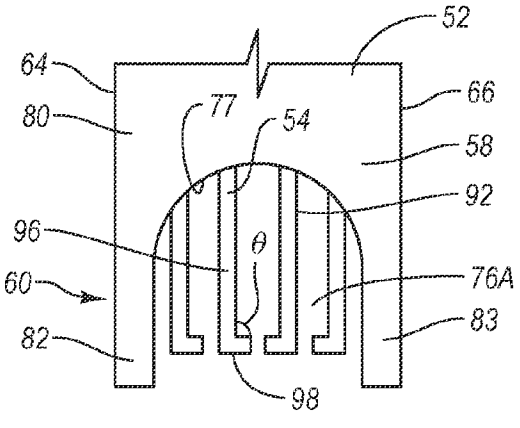
Figure 4C:
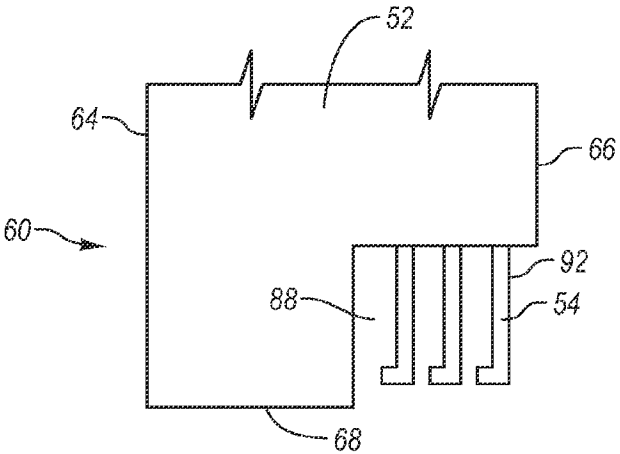

Depicted in FIG. 4C is still another alternative embodiment of first end 60 of arch body 52. In this embodiment, a passage 88 extends through first end 60 of body 52. However, in contrast to passage 88 being spaced apart from the arched first and second side faces 64 and 66, as shown in FIGS. 3, 4A, and 4B, in this embodiment passage 88 extends through both first support face 68 and also through second side face 66. First support face 68, however, is typically sized so that arch 50 can be free-standing on opposing support faces 68 and 70.

Depicted in FIG. 4D is yet another alternative embodiment of first end 60 of arch body 52. In this embodiment, a passage 89 extends through first end 60 of arch body 52. However, in contrast to passage 89 extending through first support face 68, passage 89 is spaced apart from first support face 68 and from arched first and second side faces 64 and 66 so as to be completely bounded by body 52.

Returning to FIG. 3, a plurality of third rebar sections 92 project from inside face 77 of body 52 into first passage 76 while a plurality of fourth rebar sections 94 project from body 52 into second passage 78. Again, rebar sections 92 and 94 are a portion of longer pieces of rebar that are embedded within body 52 so that rebar sections 92 and 94 are secured to body 52. The size, quantity, and position of rebar within body 52 depends on the size and structural needs of arch 50 and can be determined based on conventional structural design techniques. It is appreciated that the rebar forming the rebar sections 92 and 94 and the other rebar disclosed herein is merely one example of a reinforcing member that can be embedded within or otherwise secured to body 52, slab 22 or the other structures disclosed herein. In alternative embodiments, the rebar or portions thereof can be replaced by other reinforcing members such as rods, wire, cable, poles, studs, anchors, plates or other elongated structural members. The reinforcing members are typically made of a material having a height tensile strength, such as a metal. However, other materials can also be used.

As best depicted in FIG. 4A, each of the plurality of rebar sections 92 comprise a first portion 96 that projects from inside face 77 of body 52 into first passage 76 and an end portion 98 that is bent relative to first portion 96. End portion 98 is typically bent so as to form an inside angle θ between first portion 96 and end portion 98 in a range between about 0° and about 180° with about 45° and about 135° or about 70° to about 110° being more common and about 90° being most common. End portion 98 is bent so as to be disposed within the plane of body 52. In alternative embodiments, however, end portion 98 can also be bent so as to project toward interior surface 56 or toward exterior surface 58. As will be discussed below in greater detail, the bending of end portion 98 helps to enhance structural engagement between arch 50 and foundation 20. In alternative embodiments, however, such as depicted in FIG. 4B, end portion 98 can be eliminated so that rebar sections 92 only comprise first portions 96. Similar rebar sections 92 are also shown projecting into passages 88 and 89 in FIGS. 4C and 4D, respectively.

Figure 5:
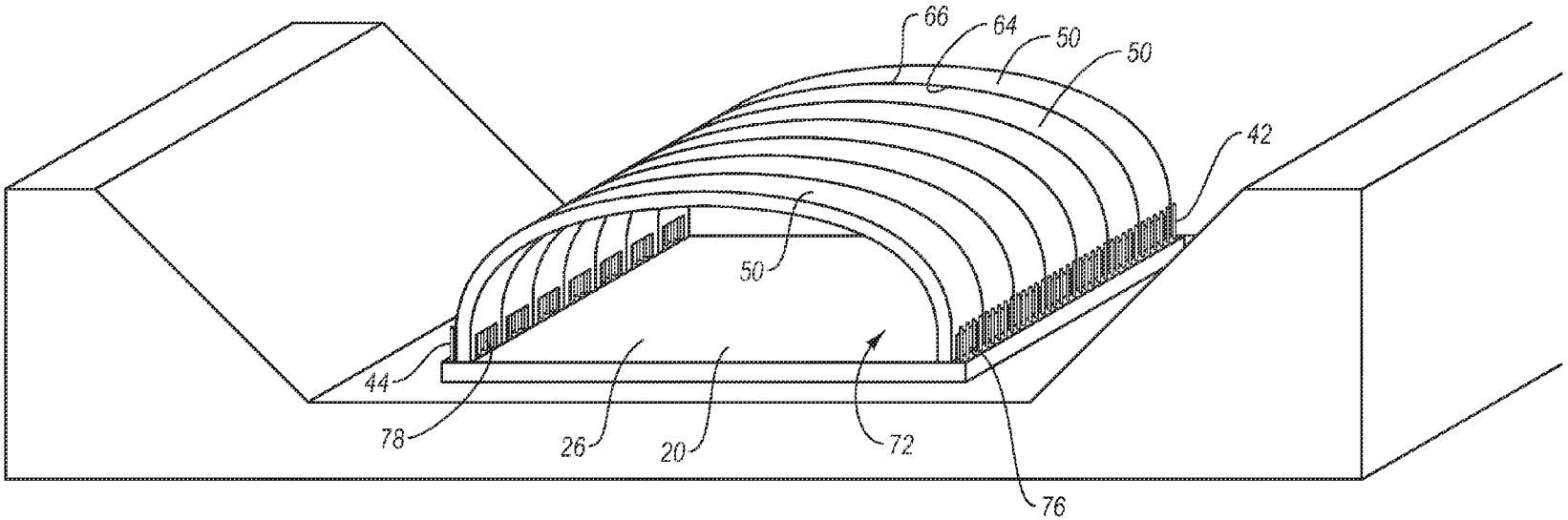
FIG. 5 is a perspective view of a plurality of the arches shown in FIG. 3 mounted on the foundation in FIG. 2.

Turning to FIG. 5, during assembly of the arched culvert, a plurality of arches 50 are positioned on top surface 26 of foundation 20 with the arches 50 being placed end to end so that the arched second side face 66 of one arch 50 is butted against the arched first side face 64 of the adjacent arch 50. In this configuration, the plurality of arches 50 and foundation 20 cumulatively bound passageway 72 extending therethrough. Each arch 50 is positioned so as to be disposed between first rebar sections 42 and second rebar sections 44. In this configuration, first passages 76 are disposed adjacent to first rebar sections 42 while second passages 78 are disposed adjacent to second rebar sections 44.

Figure 6A:
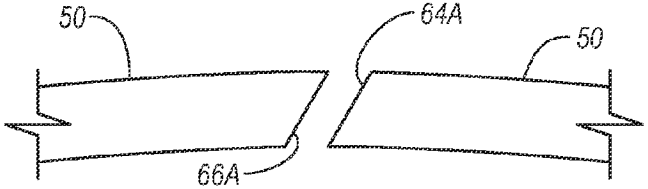
FIGS. 6A-6C are cross sectional side views of alternative embodiments of interlocking side faces of adjacent arches.
Figure 6B:
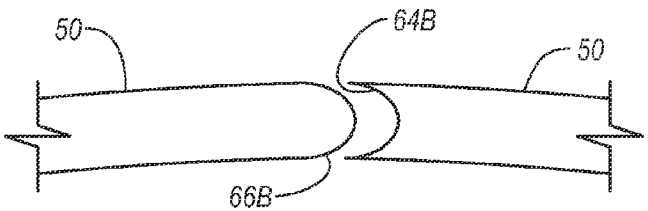
Figure 6C:
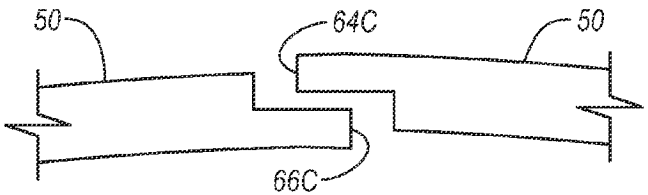

It is appreciated that the side faces 64 and 66 can simply be flat, vertical surfaces that are butted against each other to couple the arches together. In alternative embodiments, however, side faces 64 and 66 can be contoured to help form an interlocking connection therebetween. For example, depicted in FIG. 6A are a pair of arches 50 having complementary sloped side faces 64A and 66A that interlock. FIG. 6B depicts a pair of arches 50 having a side face 64B with a grooved recess and a side face 66B with a complementary bull nose for interlocking therein. Finally, FIG. 6C depicts a pair of arches 50 having complementary stepped side faces 64C and 66C that interlock when fit together. It is appreciated that a variety of other interlocking configurations can also be used. A joint compound can be placed between the interlocking side faces so that the adjacent arches are sealed together, thereby allowing the coupled arch to flow a pressurized fluid therethrough without significant leakage.

Figure 7:
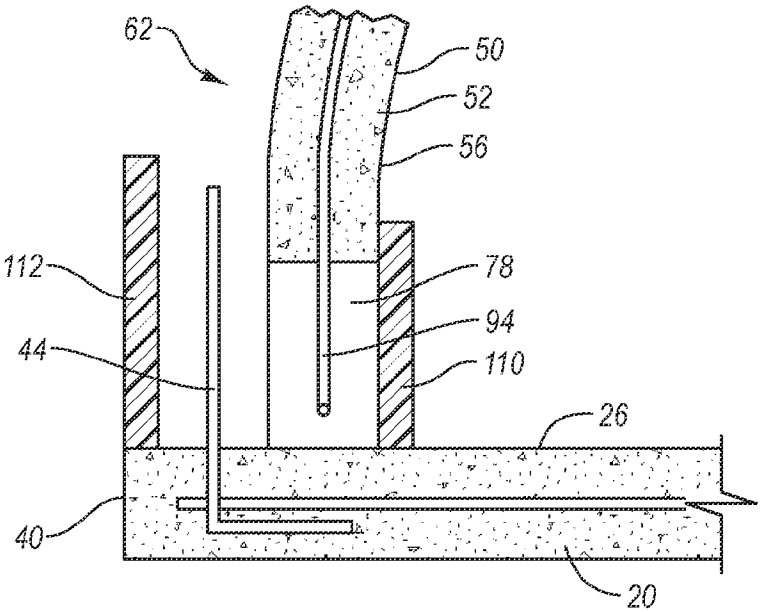
FIG. 7 is a cross sectional side view of one end of the arch mounted on the foundation as shown in FIG. 5.

Depicted FIG. 7 is a cross sectional side view showing second end 62 of an arch 50 positioned on foundation 20 adjacent to second rebar sections 44. In this assembled positioned, an inside form 110 is positioned along inside face 56 of each arch 50 so as to rest on top surface 26 of foundation 20 and cover each second passage 78. A second form 112 is mounted on foundation 20 on the side of second rebar sections 44 opposite of arches 50. Outside form 112 is positioned on top surface 26 of foundation 20, against second side face 40 of foundation 20, or can be spaced back from second side face 40 and extends along the length of arches 50. Outside form 112 projects upwardly so as to extend higher than second passages 78.

Figure 8:
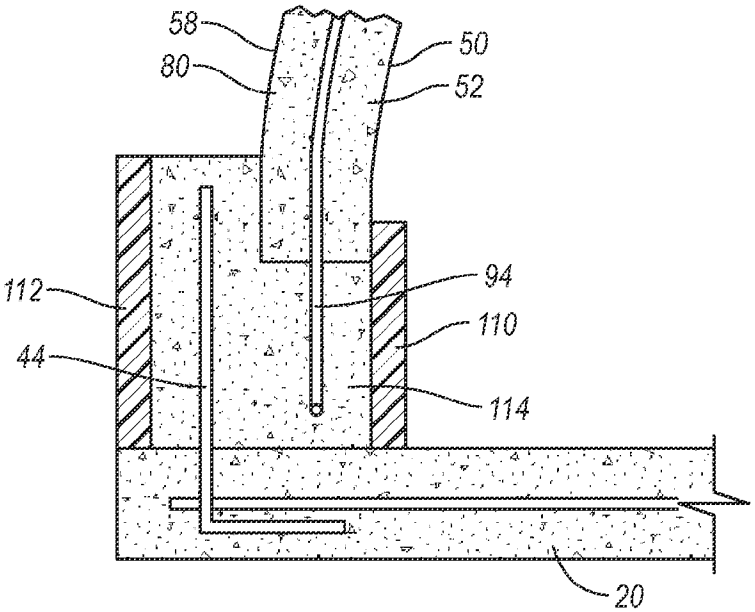
FIG. 8 is a cross sectional side view of the assembly shown in FIG. 7 wherein a locking wall is formed between the foundation and the arches.

Next, as depicted in FIG. 8, a cementitious mixture, such as concrete, is poured into the opening between inside form 110 and outside form 112 so as to form a locking wall 114 within the opening. Locking wall 114 can be formed of any of the same materials as previously discussed with regard to arches 50. Locking wall 114 encloses fourth rebar sections 94 and second rebar sections 44 at the location of second passages 78. The bending of fourth rebar sections 94 helps to facilitate engagement between rebar sections 94 and locking wall 114. If desired, second rebar sections 44 can also be bent similar to rebar sections 94.

Figure 9:
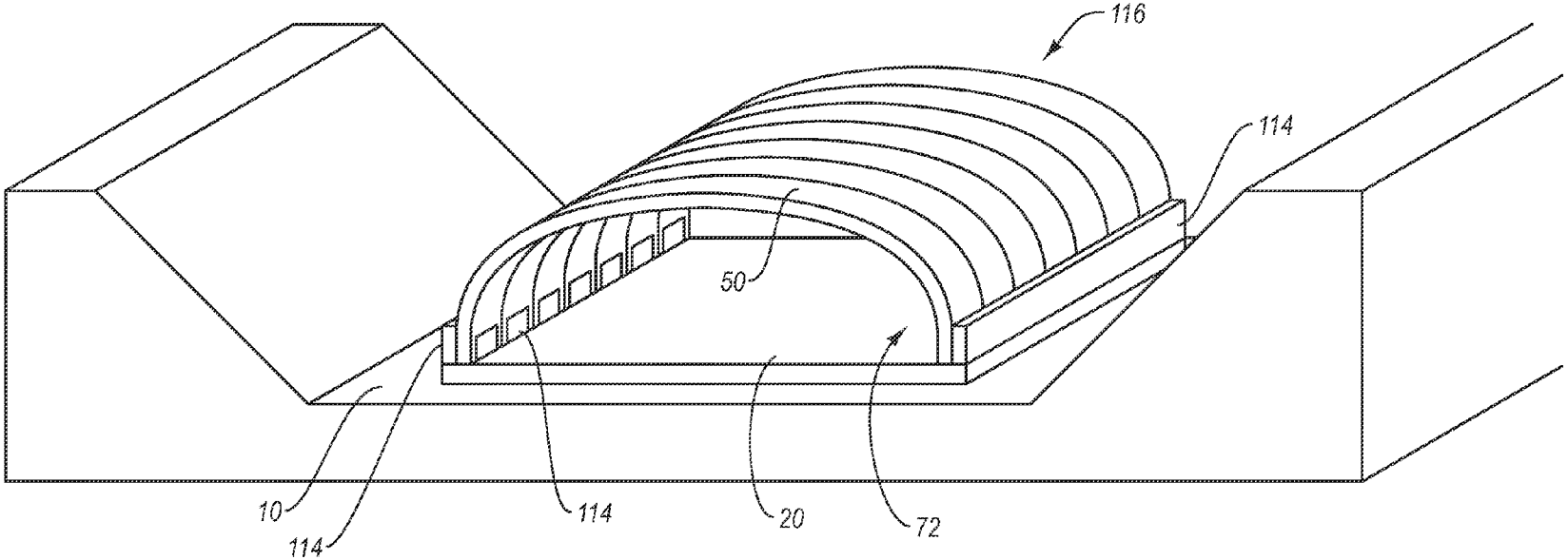
FIG. 9 is perspective view of the inventive arched culvert including the foundation, arches, and locking walls.
Figure 10:
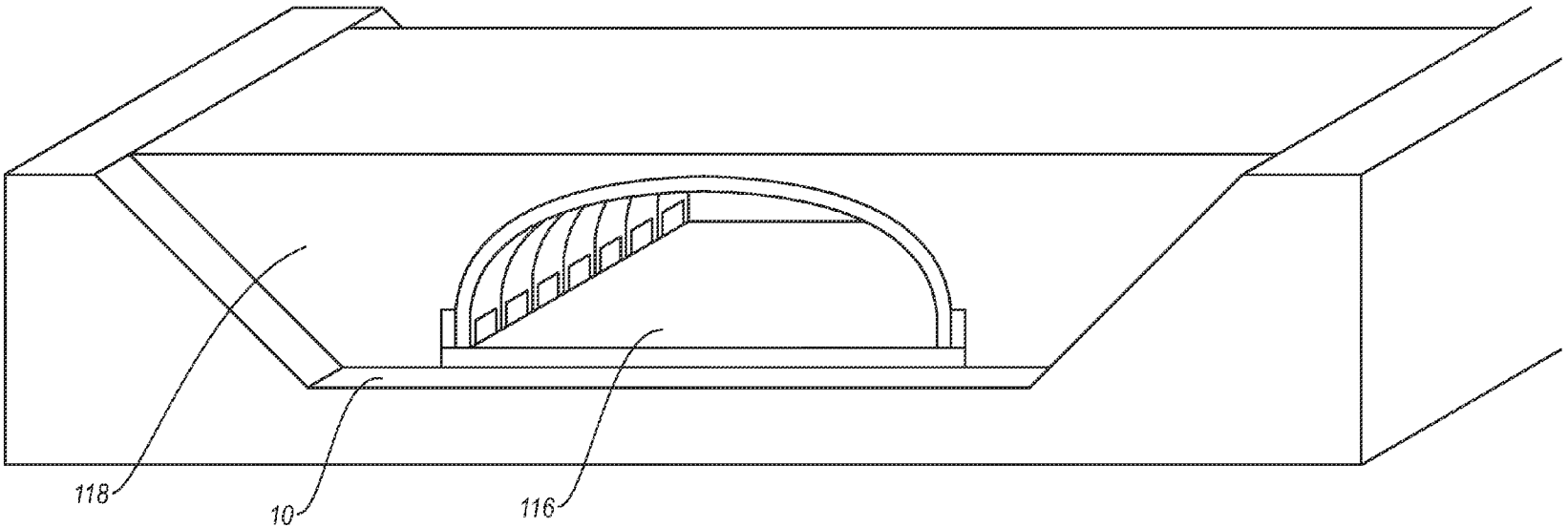
FIG. 10 is a perspective view of the inventive arched culvert having a backfill deposited thereon.

Locking wall 114 has a substantially L-shaped transverse cross section at each passage 78 which fills each passage 78 and which upwardly extends along a portion of exterior surface 58 of upper body 80. Locking wall 114 continuously extends along the length of exterior surface 58 of each of arch 50 and fills each passage 78. As a result, locking wall 114 provides a secure positive engagement between second end 62 of each arch 50 and foundation 20. Similar inside forms 110 and outside forms 112 are also positioned adjacent to first end 60 of arch 50 so that a locking wall 114 extends along exterior surface 58 of first end 60 so as to secure engagement with foundation 20 thereat. Once locking walls 114 are formed, forms 110 and 112 are removed, thereby forming a completed arched culvert 116 as shown in FIG. 9. Finally, as depicted in FIG. 10, channel 10 is backfilled with material 118 so as to cover all or portions of arched culvert 116.

Figure 1:
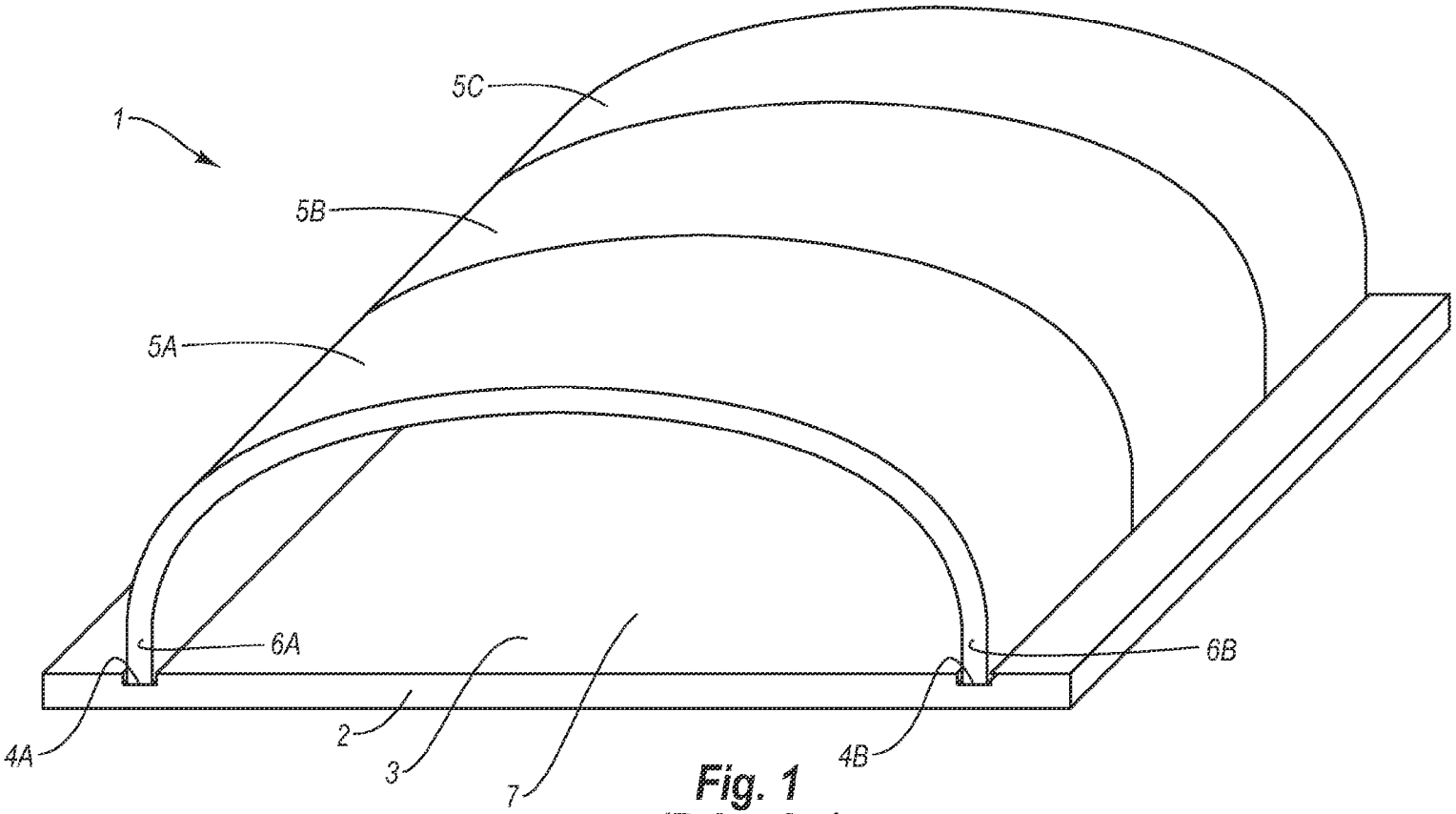
Fig. 1 (Prior Art)
FIG. 1 is a perspective view of a prior art arched culvert.

It is appreciated that the inventive arched culvert has a number of unique benefits over the prior art. By way of example and not by limitation, the inventive arched culvert eliminates the need for keyways 4A and 4B (FIG. 1). As a result, slab 22 is simpler to form and less tolerance is required for positioning arch 50 on slab 22. Furthermore, the inventive arches 50 can be shimmed at opposing ends thereof to facilitate proper alignment between adjacent arches 50 without decreasing shear strength of arches 50 relative to foundation 20. Furthermore, because arches 50 are secured to foundation 20 by positive structural engagement, the resulting arched culvert has increased moment, torsional, and shear capacity. To this end, the locking walls prevent unwanted separation between the arches 50 and foundation 20 so that the arched culvert is better able to permit the passage of pressurized fluid therein without leaking.

Figure 11:
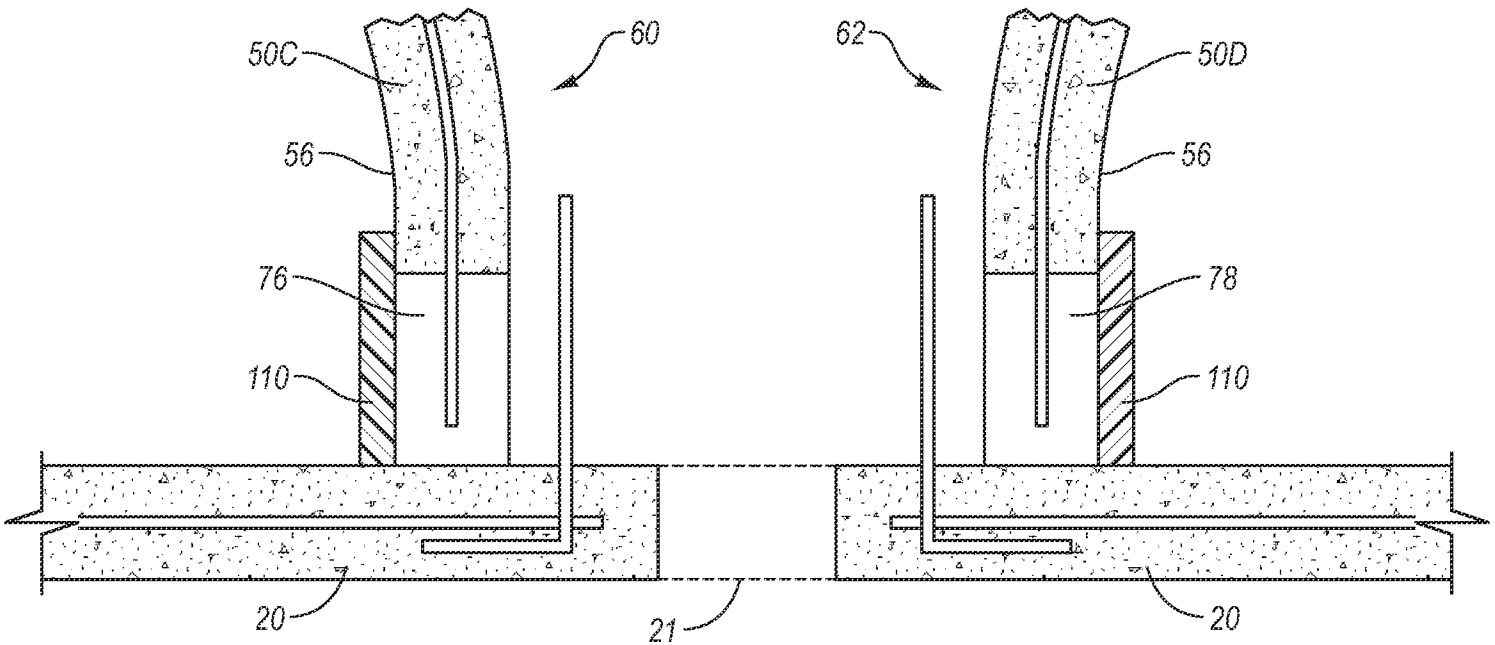
FIG. 11 is a cross sectional side view showing an alternative method of simultaneously manufacturing side by side arched culverts.
Figure 12:
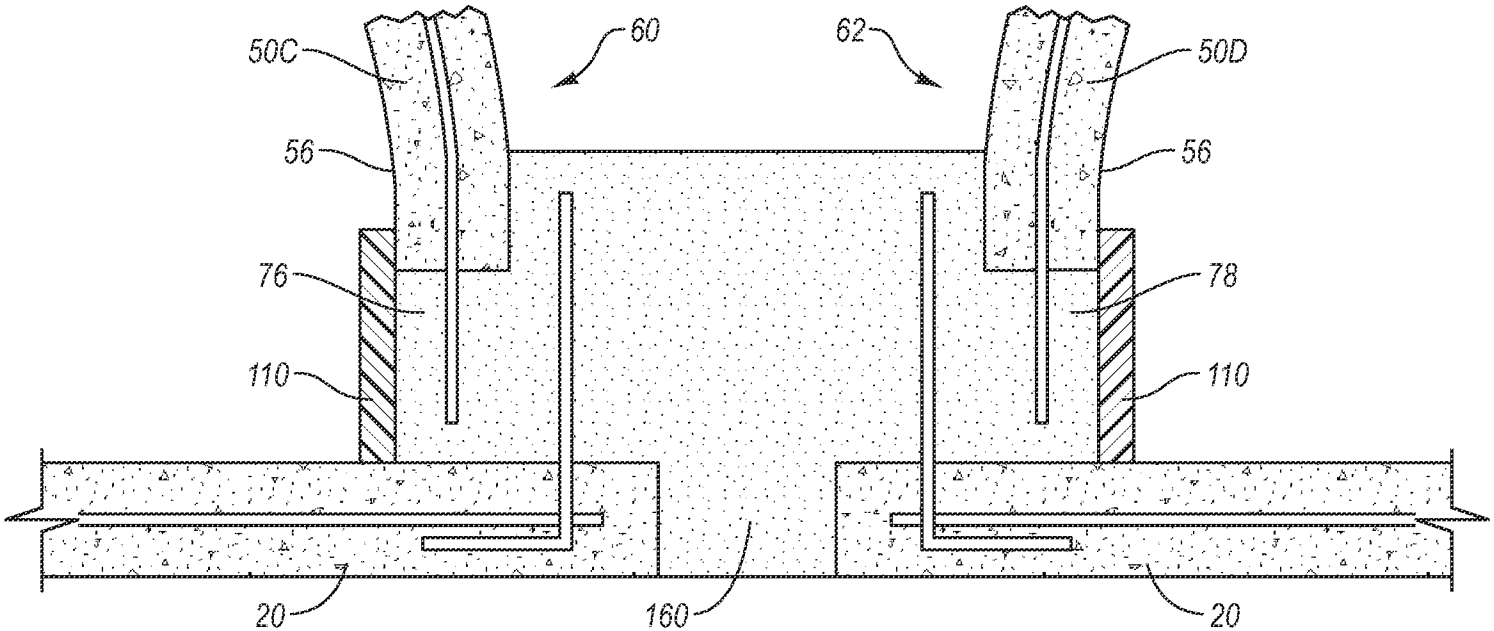
FIG. 12 is a cross section side view of the assembly shown in FIG. 11 wherein a single locking wall is formed between the side by side arched culverts.

The present invention also envisions that multiple arched culverts can simultaneously be formed in a parallel side by side arrangement. In so doing, however, a common locking wall can be formed between adjacent structures. For example, depicted in FIG. 11 is a first end 60 of an arch 50C and a second 62 of an adjacent arch 50D. As previously discussed with regard to FIG. 7, in this embodiment an inside form 110 is positioned along the inside face 56 of each arch 50C and 50D so as to rest on top of foundation 20 and cover passages 76 and 78. However, in contrast to the embodiment in FIG. 7, the outside form 112 is not used. Rather, as depicted in FIG. 12, a cementitious mixture, is poured into the opening between arches 50C, 50D so that the cementitious material fills the space between the arches and fills in the passages 76 and 78. The cured cementitious material forms a single locking wall 160 that secures in place both arches 50C and 50D in the same manner as previously discussed with regard to locking wall 114.

FIGS. 11 and 12 show that two separate foundations 20 can be used for arches 50C and 50D. In an alternative embodiment, however, separate foundations 20 can be formed as a single continuous foundation, identified by dashed lines 21 in FIG. 11, that supports both arches 50C and 50D.

Figure 13:
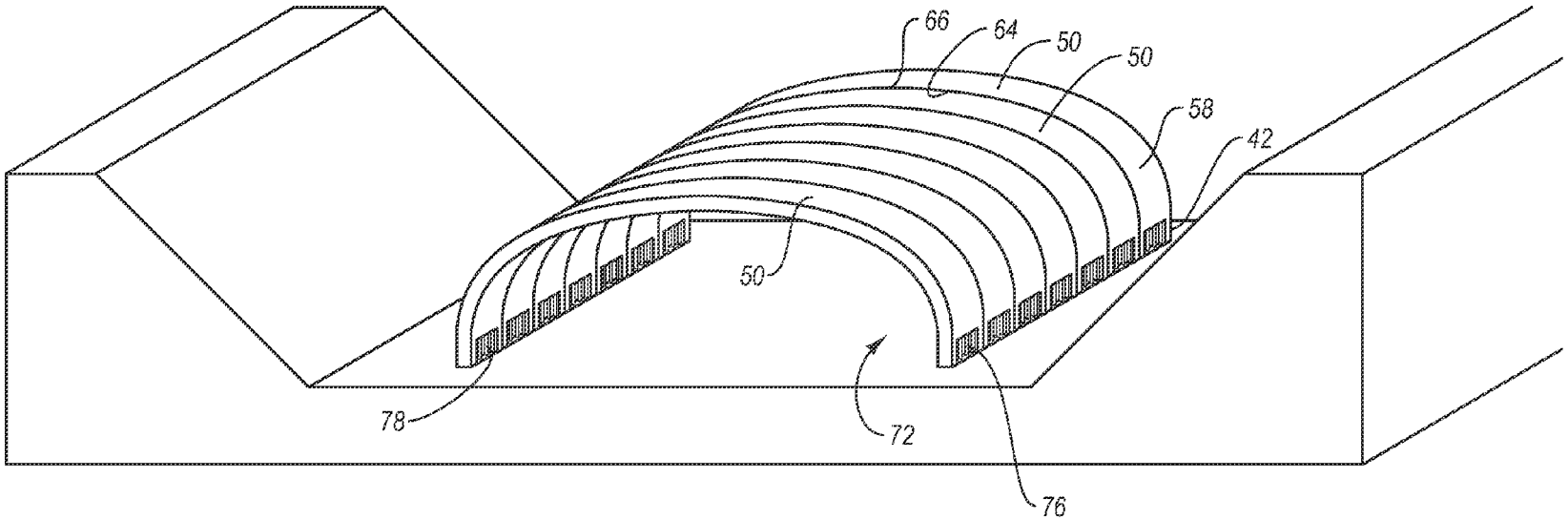
FIG. 13 is a perspective view showing an alternative method of manufacturing an arched culvert wherein arches are positioned directly on the floor of a channel.
Figure 14:
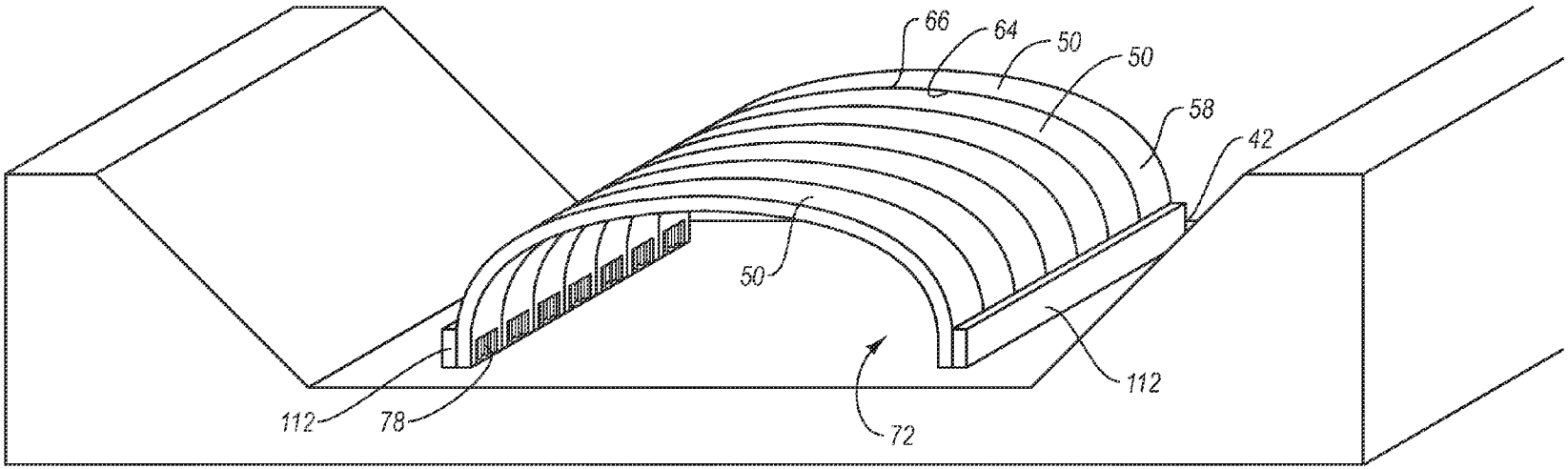
FIG. 14 is a perspective view of the assembly shown in FIG. 13 wherein forms are mounted on the exterior surface of the arches.
Figure 15:
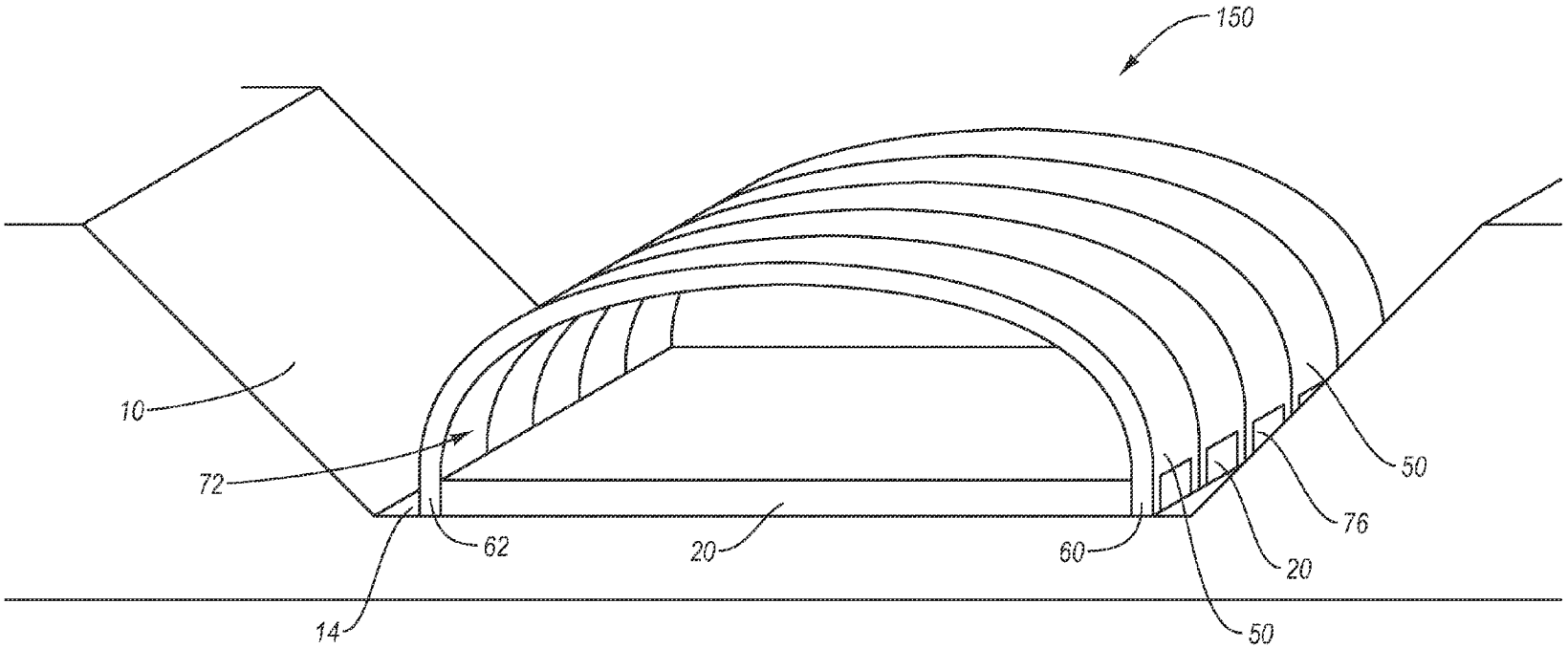
FIG. 15 is a perspective view of the assembly shown in FIG. 14 wherein a foundation has been poured within the arches so as to form an arched culvert.

The present invention also envisions other alternative ways of forming an arched culvert. It is appreciated that like structural elements between the different embodiments are identified by like reference characters. As depicted in FIG. 13, in this embodiment arches 50 are placed in side by side alignment directly on floor 14 of channel 10 as opposed to on top of foundation 20 (FIG. 2). As depicted in FIG. 14, once the arches 50 are properly positioned, forms 112 are positioned along the exterior surface 58 of arches 50 so as to cover first passages 76 and second passages 78 thereat. Finally, as depicted in FIG. 15, a foundation 20 is poured on top of floor 14 of channel 10 within passage 72 formed by arches 50. Foundation 20 extends between opposing ends 60 and 62 of the arches 50 and extends into passages 76 and 78 formed on arches 50 so that foundation 20 is secured to arches 50. Foundation 20 can be formed from a cementitious material as discussed above.

Once foundation 20 has cured, forms 112 are removed so as to form the arched culvert 150. Again, because arched culvert 150 eliminates the need for keyways 4A and 4B (FIG. 1) and results in an arched culvert where the arch is positively secured to the foundation, arched culvert 150 has many of the same benefits as discussed above with regard to arched culvert 116.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An arch comprising:

an arch body comprised of concrete and having:

an arched interior surface and an arched exterior surface each longitudinally extending between a first end and an opposing second end and each laterally extending between an arched first side face and an opposing arched second side face, the first end terminating at a first support face and the second end terminating at a second support face;

a first passage extending through the arch body between the interior surface and the exterior surface at the first end, the first passage passing through the interior surface, the exterior surface, the first support face, and the first side face; and a second passage extending through the arch body between the interior surface and the exterior surface at the second end;

a portion of a first reinforcing member projecting from the arch body into the first passage; and a portion of a second reinforcing member projecting from the arch body into the second passage.

2. The arch as recited in claim 1, wherein the first reinforcing member comprises rebar at least partially embedded within the arch body.

3. The arch as recited in claim 1, wherein the first passage has a substantially square or rectangular transverse cross section.

4. The arch as recited in claim 1, wherein the first passage has a maximum width of at least 60 cm and a maximum height of at least 20 cm.

5. The arch as recited in claim 1, wherein the arch body is a unitary one piece structure.

6. The arch as recited in claim 1, wherein the arched interior surface has a concave curvature extending along a length thereof or is comprised of a pair of vertically disposed side surfaces with a top surface horizontally extending therebetween.

7. An arched culvert comprising:

a foundation slab having a top surface that extends between a first side and an opposing second side;

a first plurality of rebar sections upwardly projecting from the top surface of the foundation slab along the first side;

a second plurality of rebar sections upwardly projecting from the top surface of the foundation slab along the second side; and a plurality of arches, each arch comprising:

an arch body comprised of concrete and having:

an arched interior surface and an arched exterior surface each longitudinally extending between a first end and an opposing second end and each laterally extending between an arched first side face and an opposing arched second side face, the first end terminating at a first support face and the second end terminating at a second support face;

a first passage extending through the arch body between the interior surface and the exterior surface at the first end; and a second passage extending through the arch body between the interior surface and the exterior surface at the second end;

a portion of a first reinforcing member projecting from the arch body into the first passage; and a portion of a second reinforcing member projecting from the arch body into the second passage, each of the arches being positioned on the top surface of the foundation slab between the first plurality of rebar sections and the second plurality of rebar sections, the plurality of arches being positioned consecutively in a side by side orientation;

further comprising a first locking wall supported on the top surface of the foundation slab and extending along the exterior surface of each of the plurality of arches and projecting into the first passage of each of the plurality of arches, the first plurality of rebar sections being embedded within the first locking wall.

8. An arched culvert comprising:

the arch as recited in claim 1 and positioned on a support surface;

a foundation formed on the support surface and extending into the first passage and the second passage, the portion of the first reinforcing member and the second reinforcing member being embedded within the foundation.

9. An arched culvert comprising:

a first foundation having a top surface with a plurality of first reinforcing members upwardly projecting therefrom;

a first arch comprising a body having an arched interior surface and an opposing exterior surface extending between a first end and an opposing second end, the first end of the first arch being positioned on the top surface of the first foundation adjacent to the first reinforcing members, a first opening extending through the first arch between the interior surface and the exterior surface at the first end thereof; and a first locking wall formed on the top surface of the first foundation so that at least a portion of the first reinforcing members are embedded within the first locking wall and the first locking wall extends along the exterior surface of the first arch and into the first opening of the first arch.

10. The arched culvert as recited in claim 9, wherein the first end and the second end of the first arch are positioned on the first foundation.

11. The arched culvert as recited in claim 9, further comprising a second foundation spaced apart from the first foundation, the second end of the arch being positioned on the second foundation.

12. The arched culvert as recited in claim 9, further comprising:

a second arch positioned adjacent to the first arch, the second arch having an arched interior surface and an opposing exterior surface extending between a first end and an opposing second end, the first end of the second arch being positioned on the top surface of the first foundation adjacent to the first reinforcing members, a second opening extending through the second arch between the interior surface and the exterior surface at the first end thereof; and the first locking wall extending along the exterior surface of the second arch and into the second opening of the second arch.

13. The arched culvert as recited in claim 9, further comprising the first arch comprising second reinforcing member projecting from the body into the first opening, the second reinforcing member being embedded within the first locking wall.

14. The arched culvert as recited in claim 9, wherein the interior surface and the exterior surface of the first arch terminate at a first support face, the first opening passing through the first support face.

15. The arched culvert as recited in claim 9, wherein the arched interior surface of the first arch comprises two spaced apart vertical side surfaces and a horizontal top surface spanning between upper ends of the vertical side surfaces.

16. The arched culvert as recited in claim 9, wherein the arched interior surface of the first arch comprises a concave surface.

17. A method for forming an arched culvert, the method comprising:

forming a foundation having a top surface with a plurality of first reinforcing members upwardly projecting therefrom;

positioning at least a first end of a first arch on the top surface of the foundation adjacent to the first reinforcing members, the first arch having an interior surface and an exterior surface with a first opening extending therebetween; and forming a first locking wall on the top surface of the foundation so that at least a portion of the first reinforcing members are embedded within the first locking wall and the first locking wall extends along the exterior surface of the first arch and into the first opening of the first arch.

18. The method as recited in claim 17, further comprising positioning a second arch adjacent to the first arch so that at least a first end of the second arch is positioned on the top surface of the foundation adjacent to the first reinforcing members, the second arch having an interior surface and an exterior surface with a second opening extending therebetween.

19. The method as recited in claim 18, wherein the step of forming a first locking wall comprises forming the first locking wall so that the first locking wall extends along the exterior surface of the second arch and into the second opening of the second arch.

20. The method as recited in claim 18, further comprising covering the exterior surface of the first arch and the second arched will with a backfill material.

21. The method as recited in claim 17, wherein the step of forming a first locking wall comprises pouring a wet cementitious mixture on the top surface of the foundation and into the first opening of the first arch.

* * * * *

UNITED STATES PATENT AND TRADEMARK OFFICE

CERTIFICATE OF CORRECTION

PATENT NO. : 8,425,152 B1
APPLICATION NO. : 12/612283
DATED : April 23, 2013
INVENTOR(S) : South It is certified that error appears in the above-identified patent and that said Letters Patent is hereby corrected as shown below:

In the Specification

Column 1
Line 60, change "relative to slab 2 as a result" to --relative to slab 2 and as a result--
Line 61, change "moving out of keyways" to --move out of keyways--

Column 2
Line 12, change "what are needed" to --what is needed--

Column 3
Line 62, change "rebar section" to --rebar sections--

Column 4
Line 66, change "exterior surface 56A" to --58A--

Column 5
Line 20, change "Notch 76" to --First passage 76--
Line 22, change "notch 76" to --first passage 76--
Line 26, change "having a curved arched" to --having a curved, arched--

Column 6
Line 39, change "first passage 76" to --first passage 76A--

Column 7
Line 21, change "assembled positioned" to --assembled position--

Column 8
Line 12, change "second 62" to --second end 62--
Line 18, change "cementitious mixture, is poured" to --cementitious mixture is poured--
Line 19, change "50C, 50D" to --50C and 50D--

Signed and Sealed this
Twenty-second Day of October, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,425,152 B1
APPLICATION NO. : 12/612283
DATED : April 23, 2013
INVENTOR(S) : South It is certified that error appears in the above-identified patent and that said Letters Patent is hereby corrected as shown below:

In the Specification

Column 1
Line 60, change "relative to slab 2 as a result" to --relative to slab 2 and as a result--
Line 61, change "moving out of keyways" to --move out of keyways--

Column 2
Line 12, change "what are needed" to --what is needed--

Column 3
Line 62, change "rebar section" to --rebar sections--

Column 4
Line 66, change "exterior surface 56A" to --exterior surface 58A--

Column 5
Line 20, change "Notch 76" to --First passage 76--
Line 22, change "notch 76" to --first passage 76--
Line 26, change "having a curved arched" to --having a curved, arched--

Column 6
Line 39, change "first passage 76" to --first passage 76A--

Column 7
Line 21, change "assembled positioned" to --assembled position--

Column 8
Line 12, change "second 62" to --second end 62--
Line 18, change "cementitious mixture, is poured" to --cementitious mixture is poured--
Line 19, change "50C, 50D" to --50C and 50D--

This certificate supersedes the Certificate of Correction issued October 22, 2013.

Signed and Sealed this
Fourth Day of February, 2014

Michelle K. Lee

Michelle K. Lee
*Deputy Director of the United States Patent and Trademark Office*